US010775139B2

(12) United States Patent
Naud

(10) Patent No.: US 10,775,139 B2
(45) Date of Patent: Sep. 15, 2020

(54) DEBRIS-FREE COMBUSTIBLE AERIAL SHELL WITH IMPROVED PYROTECHNIC DISPERSION

(71) Applicant: DMD Systems, LLC, Los Alamos, NM (US)

(72) Inventor: Darren Naud, Los Alamos, NM (US)

(73) Assignee: DMD Systems, LLC, Los Alamos, NM (US)

( * ) Notice: Subject to any disclaimer, the term of this patent is extended or adjusted under 35 U.S.C. 154(b) by 43 days.

(21) Appl. No.: 16/278,079

(22) Filed: Feb. 16, 2019

(65) Prior Publication Data

US 2019/0368844 A1 Dec. 5, 2019

Related U.S. Application Data

(63) Continuation-in-part of application No. 15/685,835, filed on Aug. 24, 2017, now Pat. No. 10,267,606.

(51) Int. Cl.

| | |
|---|---|
| ***F42B 4/02*** | (2006.01) |
| ***F42B 4/24*** | (2006.01) |
| ***F42B 4/30*** | (2006.01) |
| ***F42B 4/00*** | (2006.01) |
| ***F42B 4/06*** | (2006.01) |

(52) U.S. Cl.
CPC ..... *F42B 4/02* (2013.01); *F42B 4/00* (2013.01); *F42B 4/06* (2013.01); *F42B 4/24* (2013.01); *F42B 4/30* (2013.01)

(58) Field of Classification Search
CPC ..... F42B 4/00; F42B 4/02; F42B 4/04; F42B 4/06; F42B 4/14; F42B 4/24; F42B 4/26; F42B 4/30
USPC ..... 102/335, 352, 360, 361
See application file for complete search history.

(56) References Cited

U.S. PATENT DOCUMENTS 4,094,245 A * 6/1978 Matura ..... C06B 45/12 102/337
5,423,264 A * 6/1995 Siegler ..... F42B 4/02 102/342
5,526,750 A * 6/1996 Poor ..... F41A 9/25 102/361

(Continued)

*Primary Examiner* — James S Bergin
(74) *Attorney, Agent, or Firm* — James C. Kennedy, III, Esq., LLC; James Kennedy

(57) ABSTRACT

An aerial shell comprising at least one combustible layer of combustible material, the at least one combustible layer including an outermost combustible layer surrounding the at least one combustible layer, the outermost combustible layer configured to ignite on substantially an entire outer surface, the outermost combustible layer including a relatively higher combustion rate than the at least one combustible layer; the at least one combustible layer including an innermost combustible layer surrounding and containing at least one pyrotechnic effect and a dispersive explosive charge; the at least one pyrotechnic effect is preferentially disposed with respect to the innermost combustible layer at least one of immediately adjacent including integral with an inner surface of the innermost combustible layer and spaced away from the inner surface of the innermost combustible layer; the at least one combustible layer configured to burn substantially throughout the at least one combustible layer.

20 Claims, 9 Drawing Sheets

(56) References Cited

U.S. PATENT DOCUMENTS

| | | | | |
|---|---|---|---|---|
| 8,763,533 | B2 * | 7/2014 | Prelic | F41J 2/02 102/336 |
| 9,062,941 | B2 * | 6/2015 | Grundler | F41J 2/02 |
| 9,062,943 | B2 * | 6/2015 | Naud | F42B 4/06 |
| 9,217,624 | B2 * | 12/2015 | Naud | F42B 4/06 |
| 10,267,606 | B2 * | 4/2019 | Naud | F42B 4/24 |

* cited by examiner

DEBRIS-FREE COMBUSTIBLE AERIAL SHELL WITH IMPROVED PYROTECHNIC DISPERSION

FIELD OF THE INVENTION

This invention relates to a pyrotechnic/firework effect containing combustible aerial shell that achieves an improved time delay compared to conventional fuse to ignite a main burst of the aerial shell to thereby disperse secondary contained pyrotechnic/firework effects with controlled pyrotechnic effect dispersion whereby debris remaining from the aerial shell following ignition of the main burst is substantially reduced or eliminated.

BACKGROUND OF THE INVENTION

Most fireworks or pyrotechnics launch projectiles or pyrotechnic effects from launch tubes that may include one-use disposable cardboard tubes. An aerial shell is an example of a pyrotechnic (fireworks) projectile, where the volume inside the shell is loaded with fireworks effects adjacent to or packed within a dispersive explosive, together referred to as a main burst. The pyrotechnic effects may include many different types of effects such as colored stars, hummers, whistles, etc. In conventional operation, upon detonation of the dispersive explosive, the pyrotechnic effects are dispersed and are subsequently ignited to give a typical visual pyrotechnic effect, such as one or more of colorful, sparkling, and/or streaming effects.

The projectiles come in many different shapes and sizes and shapes, but all are typically launched from a launcher (such a tube) with a lift charge which may be contained in an outer shell of the projectile and/or within the launch tube. For example, one suitable low-smoke producing launching system that may be used is found in U.S. Pat. No. 9,062,943, the disclosure of which is hereby incorporated by reference herein in its entirety.

Several factors contribute to the pyrotechnic projectile being successfully raised to a desired selected altitude within a selected time and with a subsequent successful main burst and dispersion of a pyrotechnic effect display. For example, the type and amount of lift charge used to propel the projectile, the size and weight of the projectile, the shape of the projectile, and the time delay of a fuse to ignite the main burst, are some of the many factors that may be desirably controlled.

For example, exemplary nitrocellulose and nitroguanidine based smokeless powders may be used within the lift charge (or within the dispersive charge enclosed within the aerial shell) are described in U.S. Pat. No. 9,217,624 "Spooling pyrotechnic device" which is hereby fully incorporated herein by reference.

Projectiles that include aerial shells containing fireworks effects have typically been constructed with a shell made from non-combustible materials or materials that cannot easily sustain combustion, such as paper, cardboard, molded plastic, glue, pressed wood particles, and tape.

In cases where the projectiles have included a fuse delay, the fuse delay has typically included chemical fuses such as columns of slow burning combustible material (self sustaining combustion) located below the main burst within a projectile or shell. In addition, a typical delay fuse may take the form of a chemical or electronic fuse that may penetrate the main burst from outside the aerial shell.

One problem with prior art chemical fuse systems has included the reliable lighting of the fuses upon launch and a sustainable burn rate of the fuses during flight.

One significant problem with prior art projectiles is projectile debris fallout upon explosion of the main burst. The projectile debris fallout may be undesirable in terms of obvious environmental and safety concerns. Some approaches in the prior art taken to address debris fallout have been to make the material of the projectile/shell destructible into a finer debris upon main burst explosion.

Another associated problem has been the requirement that the shell/projectile be formed of materials sufficiently strong to withstand resulting forces during and after launch and as well as the use of materials that may be produced without associated manufacturing non-uniformities that may degrade aerodynamic properties.

Therefore there is a continuing need in the art to provide a predictable and sustainably burning delay fuse associated with a pyrotechnics effects aerial shell that has improved aerodynamic properties and which upon main burst explosion produces little or substantially no debris.

It is therefore among the objects of the invention to provide a predictable and sustainably burning delay fuse associated with a pyrotechnics effects aerial shell that has improved aerodynamic properties and which upon main burst explosion produces little or substantially no debris.

These and other objects, aspects and features of the invention will be better understood from a detailed description of the preferred embodiments of the invention which are further described below in conjunction with the accompanying Figures.

SUMMARY OF THE INVENTION

In an exemplary embodiment, An aerial shell comprising at least one combustible layer of combustible material, the at least one combustible layer including an outermost combustible layer surrounding the at least one combustible layer, the outermost combustible layer configured to ignite on substantially an entire outer surface, the outermost combustible layer including a relatively higher combustion rate than the at least one combustible layer; the at least one combustible layer including an innermost combustible layer surrounding and containing at least one pyrotechnic effect and a dispersive explosive charge; the at least one pyrotechnic effect is preferentially disposed with respect to the innermost combustible layer at least one of immediately adjacent including integral with an inner surface of the innermost combustible layer and spaced away from the inner surface of the innermost combustible layer; the at least one combustible layer configured to burn substantially throughout the at least one combustible layer.

BRIEF DESCRIPTION OF THE DRAWINGS

The disclosure will now be made, by way of example, with reference to the accompanying drawings, in which.

DETAILED DESCRIPTION OF THE PREFERRED EMBODIMENTS

Figure 1A:
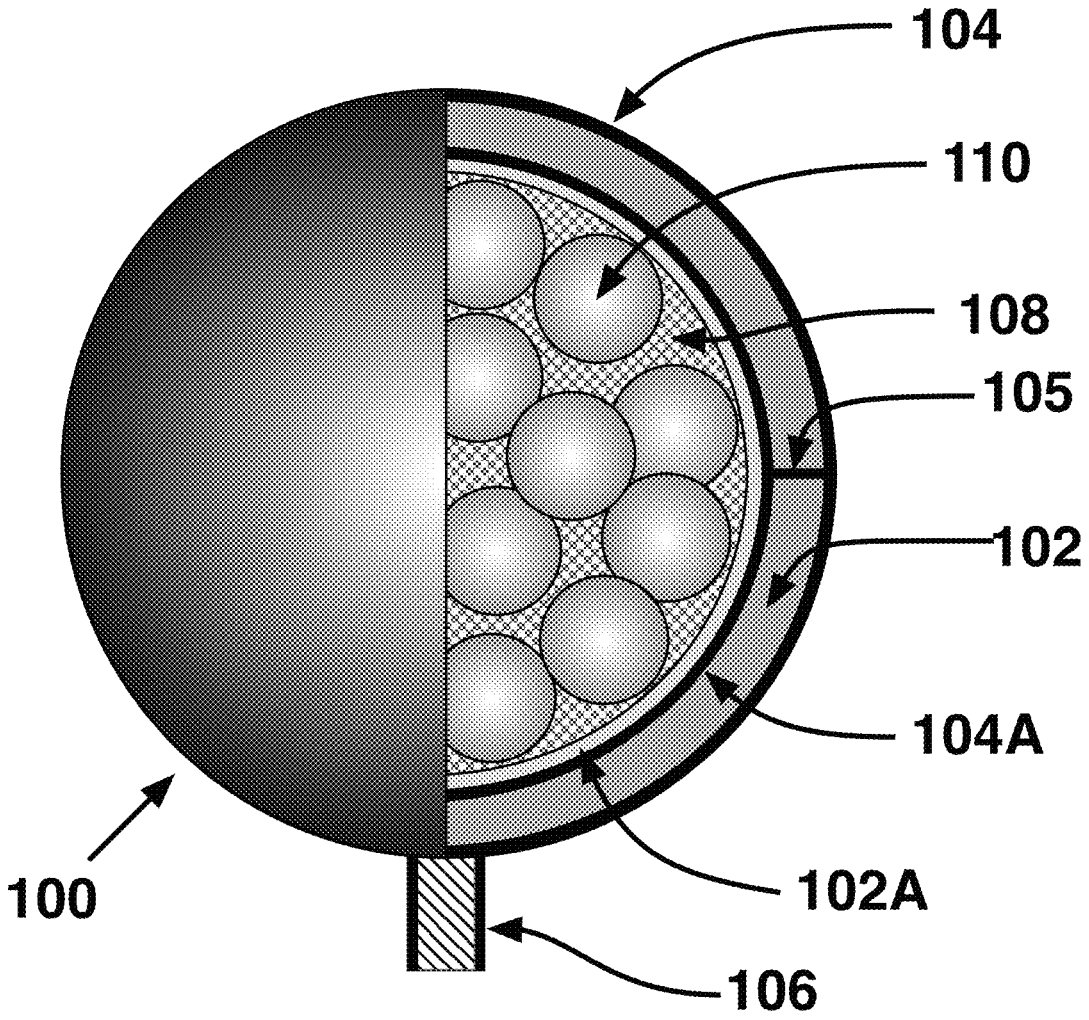
FIG. 1A is a schematic illustration of an exemplary spherical shaped combustible aerial shell according to embodiments.

Referring to FIGS. 1A-1F, in embodiments a combustible aerial shell 100 is provided that fully encloses a volume that contains a dispersive explosive charge e.g., 108 and one or more pyrotechnic (fireworks) effects, e.g., 110.

It will be appreciated that the aerial shell 100 may be in any shape such as spherical with a circular cross section, and cylindrical with a rectangular cross section. Exemplary embodiments are shown as spherical in FIGS. 1A, and 1C-1F, and as cylindrical in FIG. 1B. It will be appreciated that the arrangement of the pyrotechnic effects 110 in FIGS. 1C-1F may be adapted to aerial shells having different cross sectional shapes including cross sectional shapes determined by the inner cross-sectional shape of the mortar (launcher).

For example, the aerial shell 100 may be in any shape such as spherical, cylindrical or prolate spheroidal (e.g. football shaped), as long as the cross section at the widest part of the shape of the aerial shell (e.g., outer diameter) is about the same or smaller than the cross section (e.g., inner diameter) of the mortar.

It will be further appreciated that aerial shells can be launched from square or triangular cross-sectional shaped mortars, where the smallest inside width of the launch opening cross section of the mortars is preferably about the same to larger than the largest outer width of the cross-section of the aerial shell, which may have a similarly shaped cross-section as that of the mortar.

By the term pyrotechnic effects is meant combustion driven effects such as explosions, flashes, smoke, flames, fireworks or other audio and/or visual effects. By the term a "combustible" is meant a self sustaining combustion driven by burning of energetic material. By the term energetic material is meant one or more of explosives, pyrotechnic compositions, fireworks, propellants and fuels.

In another embodiment, the combustible aerial shell 100 is configured to function as a delay fuse to ignite the dispersive explosive charge 108 at a preselected altitude following launch from a launcher or mortar e.g., 200.

In another embodiment, the combustible aerial shell 100 may include a relatively high combustion rate (primer) of combustible material 104 as an outermost relatively integrated thin portion or layer of the aerial shell or as a thin layer coating on the outermost surface of the aerial shell (e.g., combustible layer 102).

In another embodiment, the combustible aerial shell 100 may be configured to ignite within a launch tube 202 (see FIG. 2) such as by ignition of an outer primer portion 104 and/or combustible layer 102 to subsequently burn throughout or on substantially the entire outer surface of the aerial shell (e.g., combustible layer 102), the combustion occurring in a direction toward the contained dispersive explosive charge 108.

It will be appreciated that the outer primer portion 104 (outermost combustible layer) may be ignited within the launch tube (launcher) 200 (see FIG. 2) by at least one of a lift charge e.g., 204 and/or one or more columnar shaped (tubular/string like) conventional fuses e.g., 106 (see FIG. 1A) attached to a selected portion of the outermost combustible layer 104.

For example one or more conventional fuses 106 (primary fuse) such as one or more of an electric match, squib, and black powder fuse device e.g. may be attached to a selected portion of the primer layer 104 and/or the outermost combustible layer 102, where the fuse 106 may be ignited by the lift charge or other means within the launch tube such as by an igniter fuse including one or more of electric matches, squibs, or black powder fuse devices.

As is known in the art, electric matches include a resistive wire (bridgewire) embedded in an ignitable material (pyrogen) which ignites upon applying an electric current to the resistive wire which in turn may ignite a fuse.

For example, as is known in the art, squibs may include a small tube (e.g., 2-15 mm diameter) filled with an explosive substance, with a detonator running longitudinally through the core. The detonator may be a wire connected to a remote electronic trigger for remote detonation.

Black powder fuse devices may include a combustible string, such as cotton covered with black powder which may further be embedded in a combustible tube and may include fuses known by popular names such as quickmatch, blackmatch, and crossmatch.

In some embodiments, the fuse 106 may be ignited by any method known in the art. The primary fuse 106 may in turn subsequently ignite the outermost combustible layer 104 and/or the combustible layer 102 within or outside the launch tube.

It will be appreciated that in some embodiments, the aerial shell may be launched from non-explosive mortars such as compressed air driven mortars and where a primary fuse e.g. 106 may be attached to a selected surface portion of the primer layer 104 and/or combustible layer 102 and the primary fuse e.g., 106 may be ignited by explosive or non-explosive means such as electric matches, squibs, black powder devices or any other method known in the art to thereby subsequently ignite the primer layer 104 and/or combustible layer 102.

In one embodiment the combustible aerial shell comprises at least one combustible layer e.g., 102 which comprises an energetic material which may have substantially the same composition substantially throughout the at least one combustible layer.

By substantially the entire outer surface of the aerial shell, it is meant from about 70% to about 100 percent of the outer surface, more preferably from about 90% to about 100 percent of the outer surface.

By substantially the same composition substantially throughout the at least one combustible layer is meant that the at least one combustible layer has a composition that is about the same throughout with respect to a weight percent of each ingredient determined with respect to the total weight of the combustible layer where each ingredient weight percent may vary within a range of about 0% to about 10% of the respective ingredient weight percent, more preferably within a range of about 0% to 5% of the respective ingredient weight percent.

In another embodiment, the combustible aerial shell (e.g., combustible layer 102) may be configured to substantially combust (burn) the ignited surface of the combustible aerial shell at a substantially uniform rate.

Preferably, the combustible aerial shell (e.g., combustible layer 102) is combusted and burns on substantially the entire surface at substantially the same rate so that the aerial shell burns through substantially the full thickness of the combustible aerial shell (e.g., combustible layer 102) toward the contained dispersive explosive charge 108 at substantially the same rate (e.g., within plus or minus 0% to about 10%) to thereby ignite the dispersive explosive 108 (main burst).

By substantially the entire thickness is meant, from about 80% to about 100 percent of the thickness, more preferably from about 90% to about 100 percent of the thickness.

It will be appreciated that there may be some variability in the thickness of the combustible aerial shell (such as corner portions of cylindrical shaped shells) as well as variations in the burn rate along portions of the shell (e.g., combustible layer 102) as noted above.

However, preferably the thickness of the combustible aerial shell (e.g., combustible layer 102) may be substantially about the same e.g., within a variation of about 0% to about 10% over from about 80% to about 100% of the surface, more preferably having a thickness variation of about 0% to about 5% over from about 90% to about 100% of the surface.

In addition, the preferred limits on thickness variations may be sufficiently small to allow for acceptable aerodynamic properties (e.g., minimal variations in drag) together with minimal shell debris upon explosion of the main burst 108.

Figure 1B:
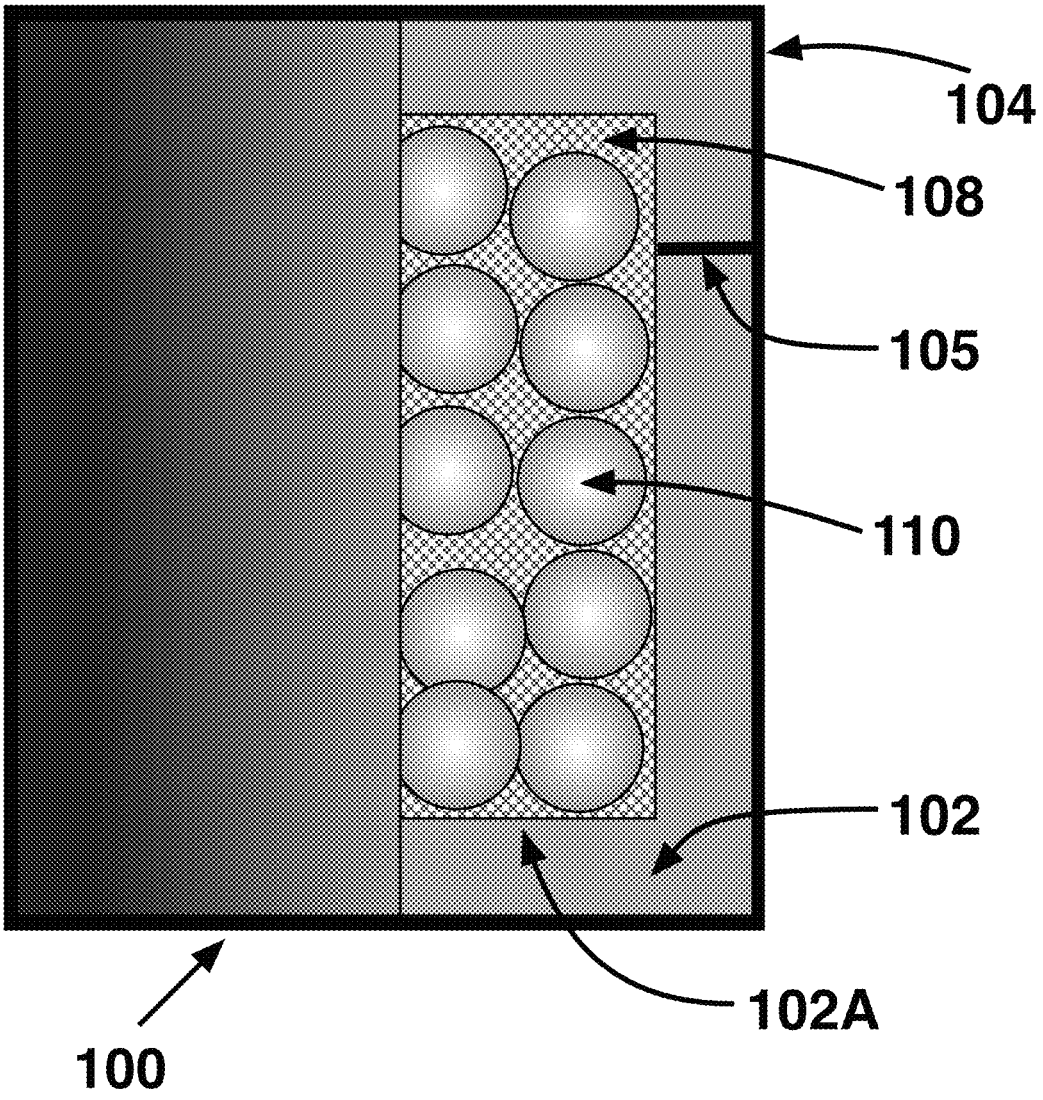
FIG. 1B is a schematic illustration of an exemplary cylindrical shaped combustible aerial shell according to embodiments.

For example in some embodiments outer corner portions on non-spheroid aerial shells (e.g., combustible layer 102 of corner portions of cylindrical shells in FIG. 1B) may be thicker than on wall portions, however this thickness variation at corner portions may be reduced by rounding of the thicker corner portions.

It will further be appreciated that any minimal amount of shell debris remaining following explosion of the main burst 108 may continue to burn relatively rapidly to thereby substantially eliminate the debris prior to reaching the ground.

In addition, the combustion rate of the aerial shell (e.g., combustible layer 102) may be substantially the same through the thickness over substantially the entire surface, such as having variations in the combustion rate to be from about preferably within about 0% to about 10%, more preferably from about 0% to about 5% over from about 90% to about 100% of the surface.

Referring again to FIG. 1A is shown a circular cross section of a spheroidal shaped aerial shell 100 with a combustible layer 102. It will be appreciated that the aerial shell 100 may be formed in any shape, including a cylindrical shape having a rectangular cross sectional shape as shown in FIG. 1B.

For example, the aerial shell 100 may be formed in non-spherical shapes such as ellipsoidal or spheroidal shapes, so long as the widest cross section dimension of the shape is about the same or smaller than the smallest width cross section dimension (inner diameter) of the mortar.

Figure 2:
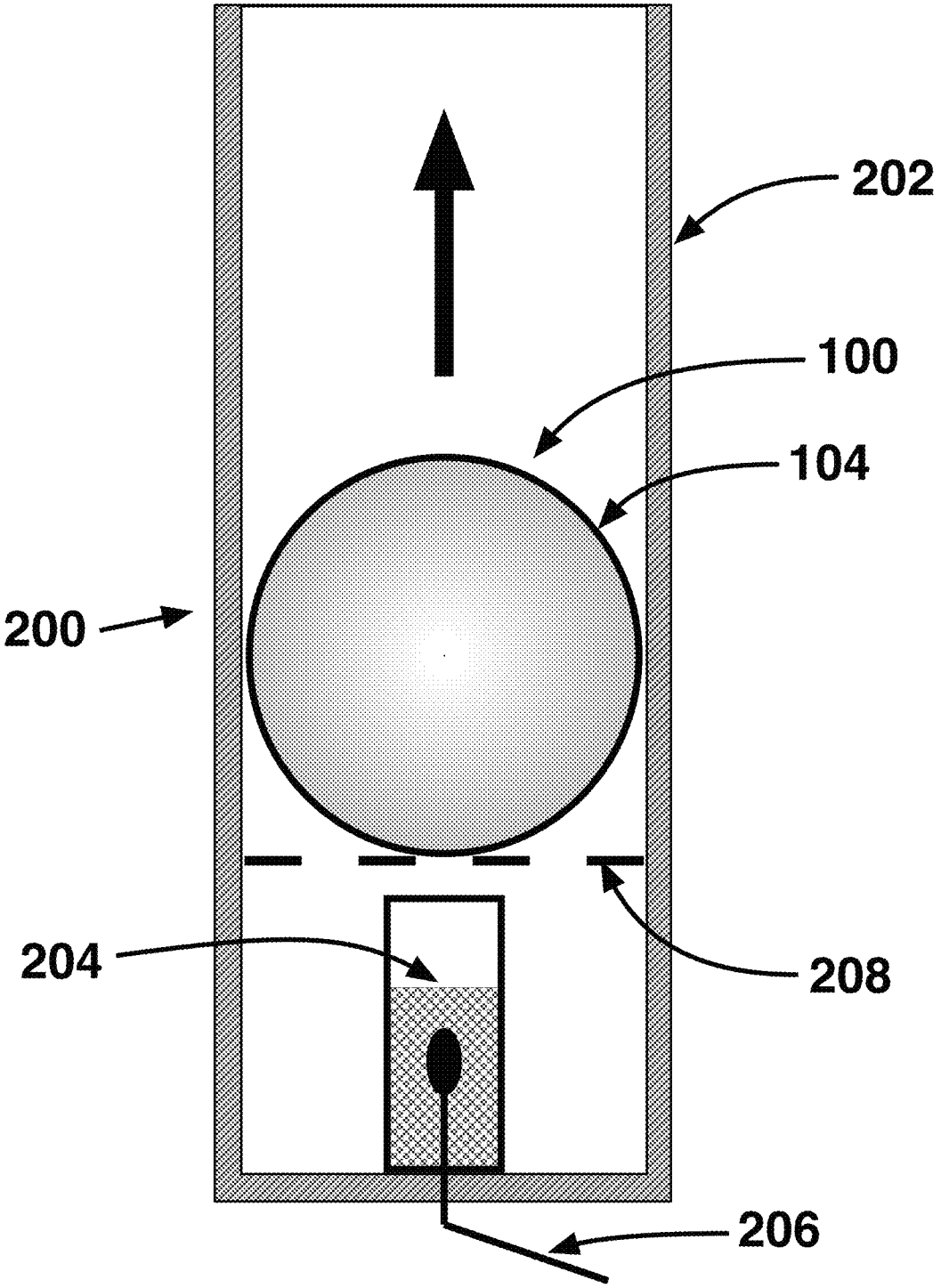
FIG. 2 is a schematic illustration of an exemplary combustible aerial shell in a launcher according to embodiments.

Preferably the aerial shell is formed in a shape such that widest outer cross sectional dimensions of the shape may substantially mate with the inner diameter dimensions (walls) of a launcher (e.g., having about the same to smaller outer cross sectional dimension with respect to the inner cross sectional dimension of the launcher walls), preferably to have a desirably efficient launch from the lift force source such as ignition of the launch charge 204. In one embodiment, the outer edges (dimensions) of the aerial shell (e.g., including outer primer layer 104) are disposed within about 0 to about 10% of the diameter of the outer edges of the aerial shell with respect to the inner walls of the launcher when place in a launcher (mortar), e.g., 200, as shown in FIG. 2.

In another embodiment, the combustible layer 102 may be formed upon a relatively thin support layer 102A (innermost combustible layer), that also may be combustible, which may have a thickness about 1% to about 10% of the combustible layer 102, and which may have a combustion rate greater or less than that of combustible layer 102A. It will be appreciated that multiple layers of combustible material may be used to form the aerial shell.

In some embodiments, at least one relatively high combustion rate layer may be configured to overly, or be interleaved with, relatively lower combustion rate layers.

For example, in one embodiment, a separate or integrated high combustion rate portion e.g., 104A (acting as a primer/igniter) may be disposed between the combustible layer 102 and the support layer 102A such as being disposed on the outer portion of support layer 102A (or inner portion of combustible layer 102) e.g. coated on the outer portion of 102A (or inner portion of 102) and/or integrated into 102A and/or 102. The high combustion rate portion (inner primer layer) 104A may have a combustion rate that is greater than that of support layer 102A and/or combustible layer 102). For example, the combustion rate of the high combustion rate portion 104A may have a combustion rate from about 5 to about 50 times greater that the combustion rate of the support layer 102A and/or combustible layer 102. It will be appreciated that the support layer 102A may be combustible and include a material such as nitrocellulose.

In a related embodiment, a separate or integrated high combustion rate portion e.g., 104 (acting as a primer/igniter) may be preferably disposed on the outermost portion of the combustible layer 102, where the high combustion rate portion 104 has a combustion rate that is greater than that of combustible layer 102. For example, the combustion rate of the high combustion rate portion (layer) 104 may have a combustion rate from about 5 to about 50 times greater that the combustion rate of the combustible layer 102.

In one embodiment, the high combustion rate portion (primer) e.g., 104 on combustible layer 102 and/or 104A on support layer 102A may have a thickness about 1% to about 20% of the thickness of the adjacent combustible layer 102. It will be appreciated that the primer material may be coated by conventional methods onto underlying layers such as the combustible layer 102 and/or a support layer 102A following formation of the respective layer. Such coating methods may include spraying, painting, dipping, vapor deposition or any other coating technique.

In a preferred operation, the relatively higher combustion rate layer 104 may be configured to ignite from the launch charge gases following ignition of a lift charge e.g., 204 within the launcher 200 (see FIG. 2), and where substantially the entire surface combustible layer 102 is ignited as it is propelled upward and/or out of the launcher 200.

In other embodiments, the relatively higher combustion rate layer 104 and/or combustion layer 102 may be ignited by one or more fuses e.g. fuse 106 (see FIG. 1A) attached to the respective higher combustion rate layer 104 and/or combustion layer 102. As previously noted, the fuse may be ignited by the launch charge gases following ignition of a lift charge, or by other conventional means such as one or more of a electric match, squib, and black powder fuse device, which in turn may ignite the respective higher combustion rate layer 104 and/or combustion layer 102 within or outside the launch tube.

The aerial shell 100 and associated combustible layers, e.g., combustible layer 102, may be formed with a selected substantially uniform thickness, for example varying by about 0% to about 10% of the thickness. It will be appreciated that the combustion rate of the aerial shell will depend on several factors including properties and materials of the combustible layers.

Preferably, the burn (combustion) rate of the aerial shell is substantially uniform along the entire surface of the aerial shell, for example having a variation of from about 0 to about 10%, more preferably from about 0% to about 5%.

In some embodiments, one or more pyrotechnic effects 110 may be disposed within or adjacent to the explosive dispersant 108 which may include one or more fuels and/or oxidizers including those ingredients listed below as additives for the combustible layer 102 including one or more of ammonium and/or metal nitrates, perchlorates, phosphates, carbonates, aminotetrazoles, arsenites, oxalates, oxychlorides, peroxides, oxides, sulphates, fluorides, and metal powders. Preferably the explosive dispersant 108 has a combustion rate that is explosive, e.g., combusts at rates typical to produce an energetic explosion.

Figure 1C:
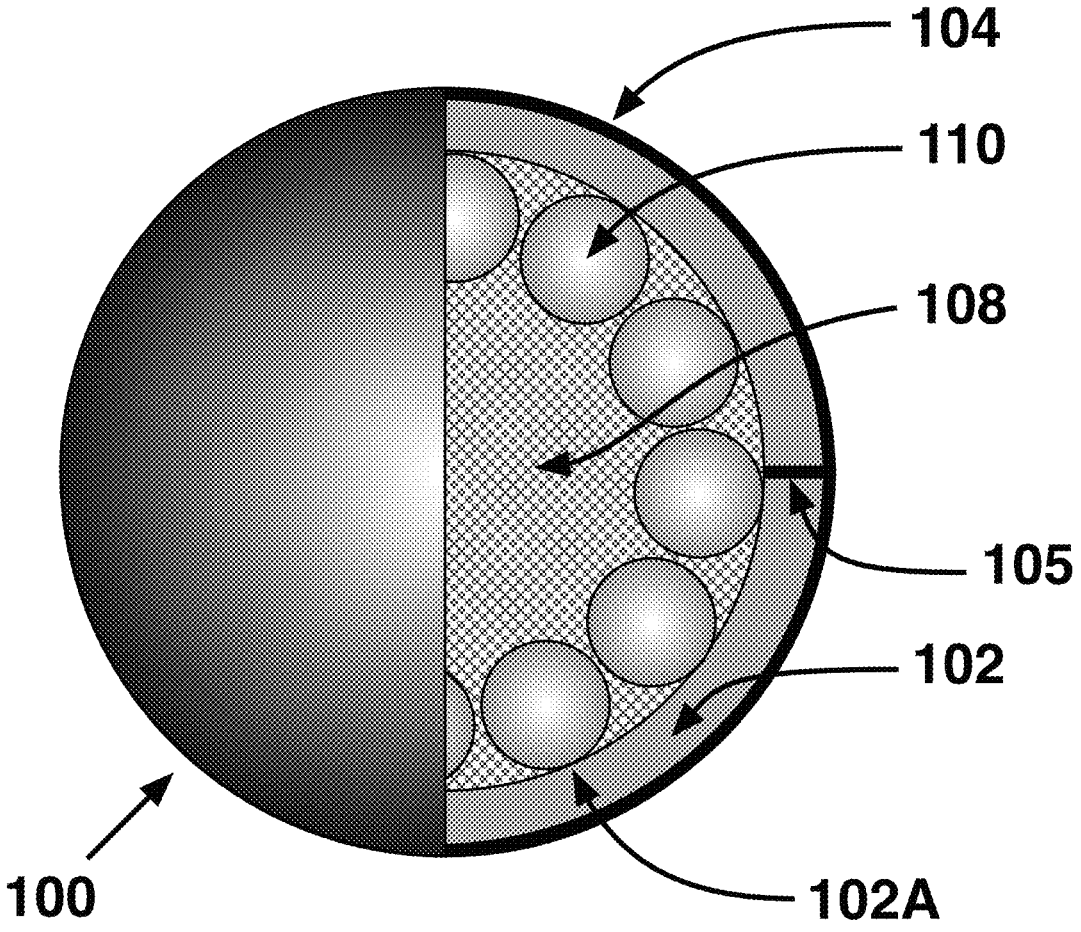
FIG. 1C is a schematic illustration of an exemplary combustible aerial shell showing an arrangement of pyrotechnic effects according to embodiments.

In some embodiments, as shown in FIG. 1C, one or more pyrotechnic effects 110 may be preferentially disposed adjacent such as immediately adjacent the innermost portion (inner surface) of combustible layer 102 or innermost portion of support layer 102A.

For example, preferentially disposing the pyrotechnic effects 110 such as immediately adjacent the innermost portion (inner surface) of combustible layer 102 and/or innermost portion of support layer 102A may allow control over the dispersion of the pyrotechnic effects 110, for example to be dispersed in a more evenly and widely dispersed pattern following ignition of the dispersant charge 108.

Figure 1D:
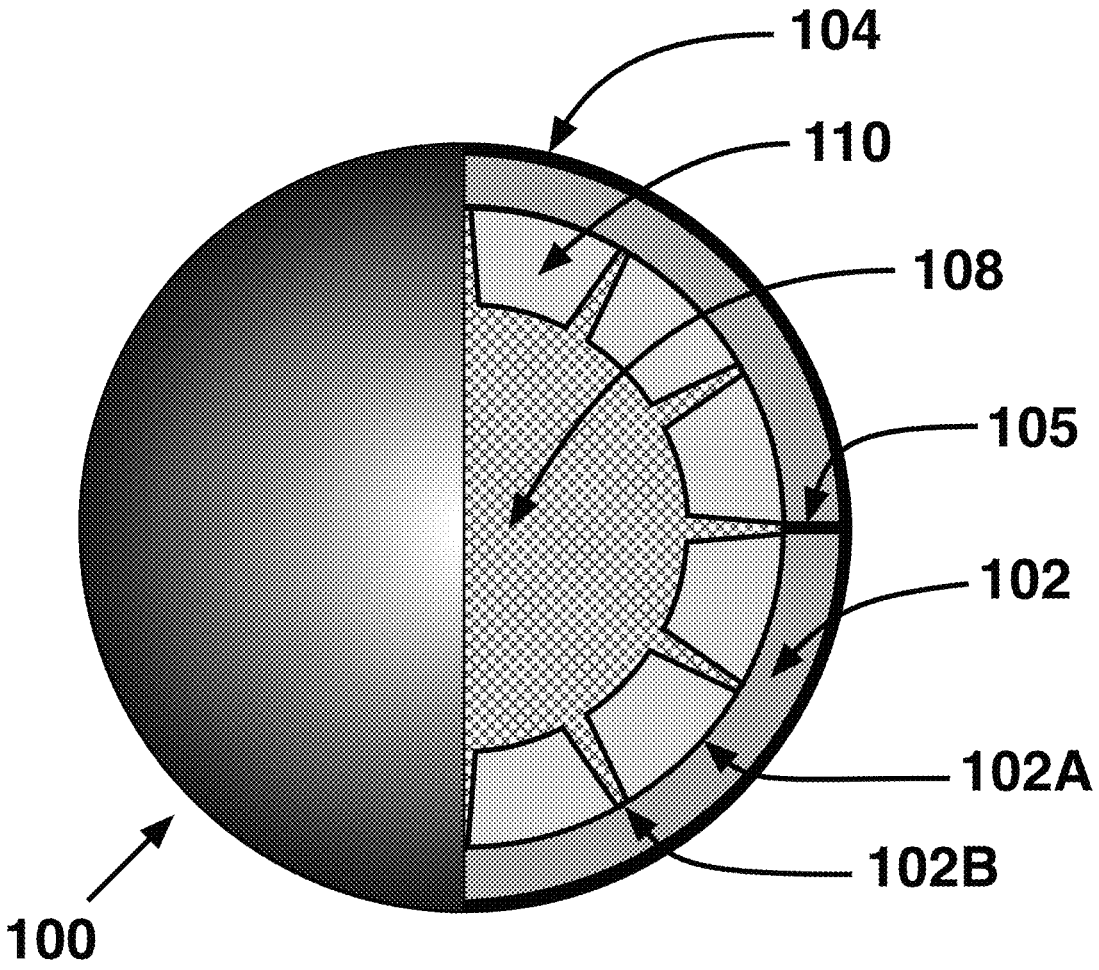
FIG. 1D is a schematic illustration of an exemplary combustible aerial shell showing an arrangement of pyrotechnic effects according to embodiments.

In a related embodiment, as shown in FIG. 1D, the pyrotechnic effects 110 can be molded onto or shaped for attachment to the inner surface of 102A (or 102) by glue and/or conventional mechanical means.

Figure 1E:
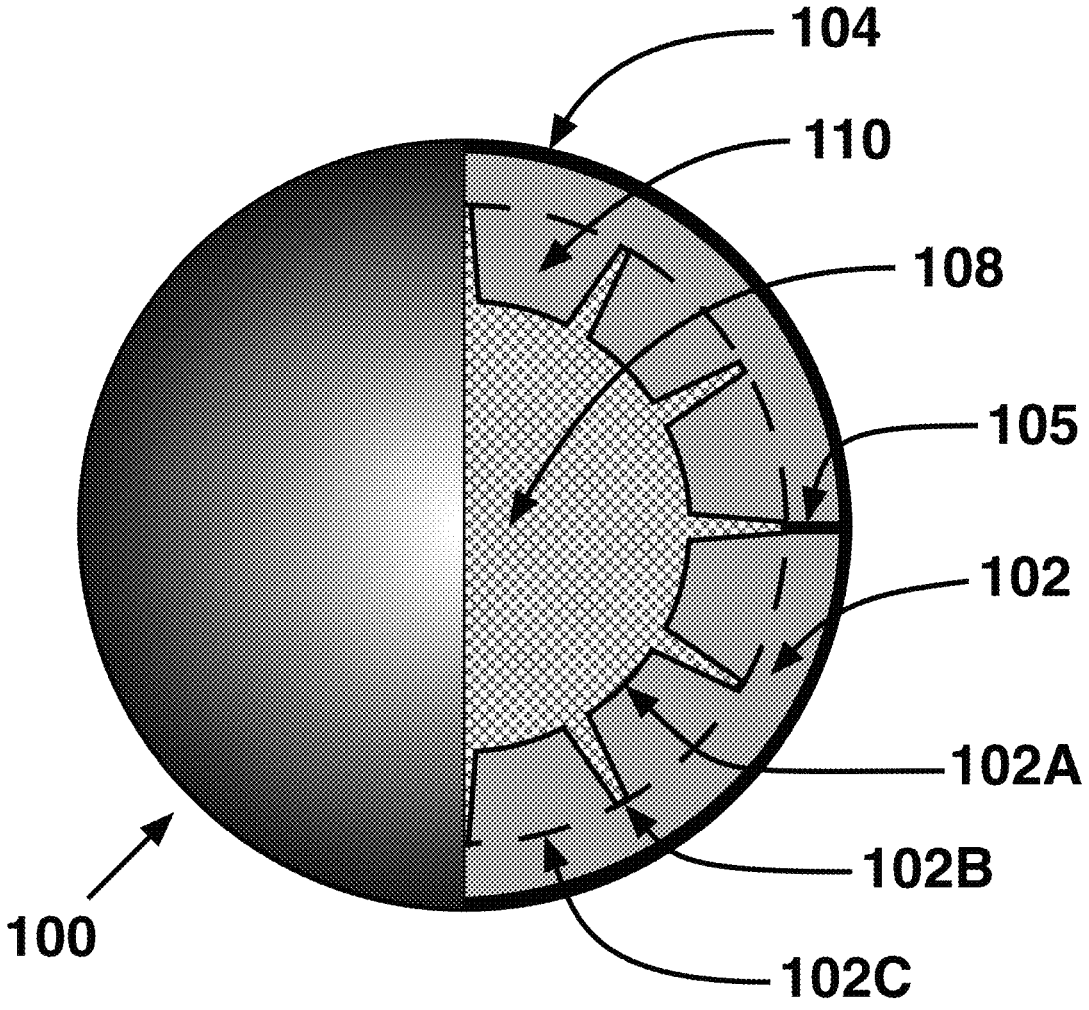
FIG. 1E is a schematic illustration of an exemplary combustible aerial shell showing an arrangement of pyrotechnic effects according to embodiments.

In another related embodiment, as shown in FIG. 1E, the pyrotechnic effects 110 may be molded onto or shaped to be made integral with the inner surface of combustible layer 102 or support layer 102A. For example, a single or multi-piece structure having pyrotechnic effects 110 integral with or attached to the inner surface of combustible layer 102 or support layer 102A may be made by conventional molding, pressing and/or 3D printing and/or gluing and/or mechanical means.

In preferred operation, during combustion of the entire outer surface of the combustible layer 102 (forming a combustion front), the combustible layer 102 may decrease in diameter at substantially the same rate until the combustion front reaches an inner diameter such as 102B (which may coincide with inner surface of 102A or an inner surface 102C of 102, which may be immediately adjacent explosive dispersant 108), whereupon the combustion front may ignite the explosive dispersant 108 and propel the pyrotechnic effects 110.

It will be appreciated that the chemical makeup of pyrotechnic effects 110 may be different from or the same as that of combustible layer 102 and/or support layer 102A.

Figure 1F:
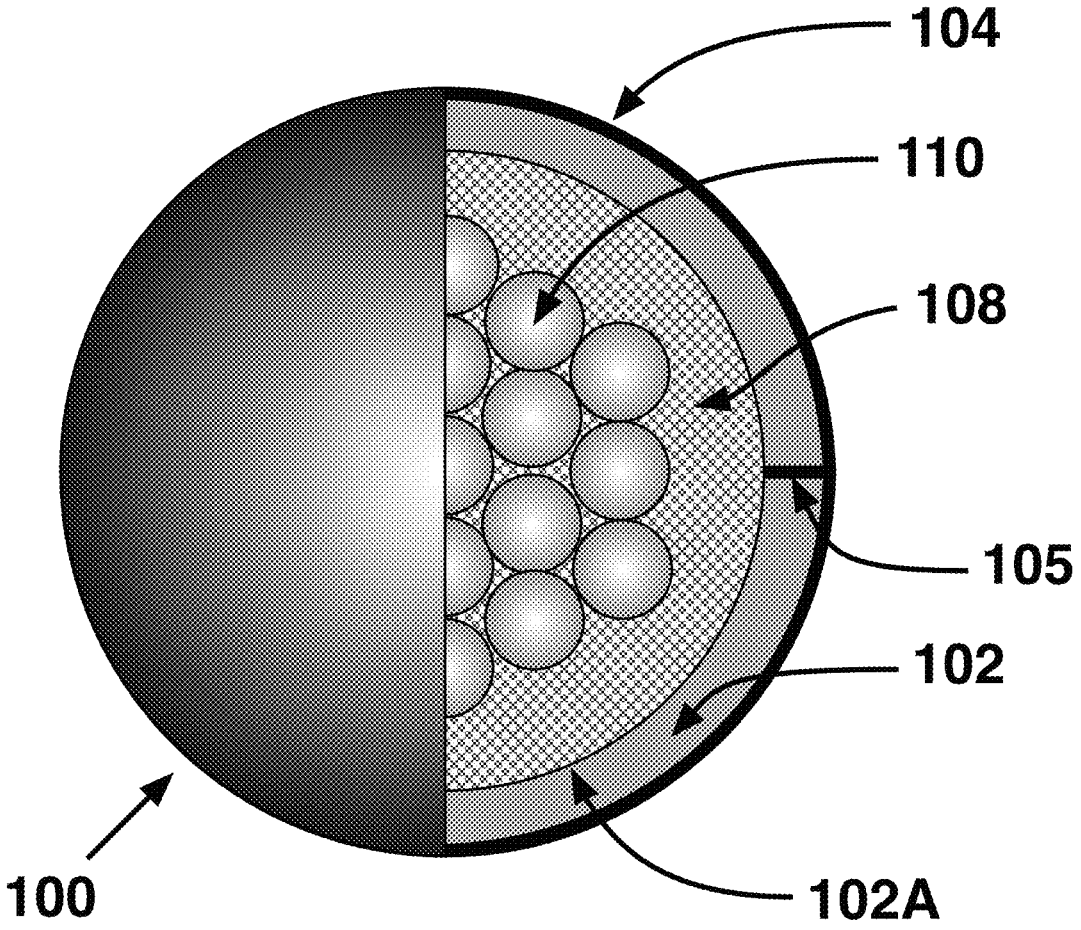
FIG. 1F is a schematic illustration of an exemplary combustible aerial shell showing an arrangement of pyrotechnic effects according to embodiments.

In another embodiment, as shown in FIG. 1F, the one or more pyrotechnic effects 110 may be preferentially disposed spaced away from the innermost portion of the combustible layer 102 and/or support layer 102A, such as preferentially disposed toward a central portion of the aerial shell containing the explosive dispersant 108.

For example, preferentially disposing the pyrotechnic effects 110 such as spaced away from the innermost combustible layer and/or support layer 102A toward a central portion of the aerial shell may allow control over the dispersion of the pyrotechnic effects 110 upon ignition of the explosive dispersant, for example in a more tightly dispersed pattern.

It will be appreciated that the explosive dispersant 108 may be disposed between and/or adjacent to, for example to surround the pyrotechnic effects 110 to achieve a predetermined density of pyrotechnic effects 110 with respect to the explosive dispersant 108.

In some embodiments other ingredients such as colorants or other pyrotechnic effect producing additives may be present in the combustible layer 102 and may be configured to burn with a pyrotechnic effect during flight following launch.

For example, the combustible layer 102 may include fuels and/or oxidizers (which may also function as colorants).

In one embodiment, the combustible layer 102 may include fuels such as nitrocellulose, including low-smoke formulations including nitro-guanidine and nitrocellulose as outlined in U.S. Pat. No. 6,599,379, "Low-smoke nitroguanidine and nitrocellulose based pyrotechnic compositions" which is incorporated herein by reference. For example, the nitrocellulose may be in powder or fiber form.

In some embodiments the combustible aerial shell (e.g., combustible layer 102) may further include one more fuels as are known in the art including metal fuels such as magnesium, aluminum, silicon, calcium, iron, titanium, zinc, and their alloys, and including non-metal fuels such as charcoal, sulfur, boron, hexamine, nitroguanidine, dextrin, camphor, red gum benzoic acid, and cellulose. The amount of fuels in the combustible aerial shell composition (e.g., combustible layer 102) may be from 0-80 wt. % based on the total weight of the respective layer e.g., combustible layer 102.

In another embodiment, pyrotechnic producing additives such as transition and rare earth element containing materials, e.g., containing elements such as Mg, Sr, Ti, and the like may be present in relatively low amounts for visual effects e.g., less than about 10 wt. % In addition, visual effect producing materials (e.g., including one or more of color, spark, and flash effects) (colorants) may be included such as chlorine containing materials and metal colorants as are known in the pyrotechnic art including one or more of Sr(NO)3, SrCO3, PARLON™, Ammonium Perchlorate (AP), hexachloroethane, paroils (chlorinated short-chain hydrocarbons) and polyvinylchloride (PVC), and the like.

For example, colorants and/or oxidizers as are known in the art may be provided in the aerial shell (e.g., combustible layer 102) including one or more of ammonium and/or metal nitrates, perchlorates, phosphates, carbonates, aminotetrazoles, arsenites, oxalates, oxychlorides, peroxides, oxides, sulphates, fluorides, and metal powders.

In some embodiments the colorants and/or oxidizers may be present in an amount of from about 10 to about 90 wt. %, more preferably, in an amount less than about 80 wt % respect to the total weight of the combustible aerial shell (e.g., combustible layer 102).

In other embodiments, e.g., for low smoke formulations, the colorants and/or oxidizers may be present in an amount of amount from 5 to 50%, preferably less than 35% respect to the total weight of the respective combustible aerial shell layer (e.g., combustible layer 102). Low-smoke formulations may have relative large amounts of nitrocellulose, or a combination of nitrocellulose and nitroguanidine, for example from about 30 to about 90 wt %.

In one embodiment the combustible aerial shell including combustible layer 102 may be produced by one or more shape formation methods known in the art such as high or low pressure pressing methods, with or without a solvent, such as conventional hot press or cold press methods.

In another embodiment, molding methods, such as conventional wet or dry molding methods may be used to shape form the combustible aerial shell layer 102.

In other embodiments, 3-D printing methods may be used to form one or more of the layers in a combustible aerial shell, such as support layer 102A, and layer 102, including and including associated igniting or primer layers e.g., 104. It will be appreciated that the one or more layers may be provided in one or more of a molten state, a solution, a viscous solid, and/or an uncatalyzed/uncured binder-containing material. It will further be appreciated that 3-D printing methods may be used to "print" (form) the combustible aerial shell 100 (e.g., including combustible layers 102A, 102, and 104, 104A) into a final combustible shape, which may be treated to catalyze/cure the layers between printing of layers and/or following printing of a completed layered shape.

In one embodiment, the combustible aerial shell may be shape formed in one or more pressed or molded pieces and then attached along seams (e.g., 105), for example, with a combustible glue, to surround a main burst disposed within, e.g., including the dispersive charge e.g., 108, and one or more pyrotechnic effect pieces e.g., 110, such as stars, streamers, hummers, whistles, or any other pyrotechnic effect.

In one embodiment, the combustible aerial shell layer 102 may include cross-linkable organic polymers, such as in a binder or additive, the cross linking taking place during or following shape forming, for example, using a cross linking treatment including one or more of heating, radiation, and/or addition of cross linking catalysts and/or accelerants. It will be appreciated that cross-linking includes polymer linkages formed in a directions transverse to other polymer linkage directions to thereby form a polymer linkage web-like pattern.

In some embodiments, a liquid-phase binder may be used to form the combustible aerial shell layer 102. The binder may be mixed with granular material comprising combustible (energetic) material such as fuels used for the combustible aerial shell layer 102 and other pyrotechnic effect producing additives.

In other embodiments the binder may be a solid binder dissolved in a solvent, or partially dissolved in solvent, or softened by solvent or a mixture of solvents.

In some embodiments, the solid or liquid binder may include one or more of polymers or copolymers of polyvinyl nitrate, nitrocellulose, polyvinyl chloride, polyvinyl acetate, and chlorofluoroethylene.

In other embodiments, the binder may include one or more polymerizable or cross-linkable materials such as thermosetting polymers, rubber, including one or more of polybutadiene, polyurethane, furans, and organic resins such as acrylic resins, polyester resins, epoxy resins, vinyl and vinyl ester resins.

In some embodiments, during the aerial shell layer 102 formation process, e.g., following the addition of the combustion producing ingredients and the pyrotechnic effect producing ingredients and following a shape forming process, the binder may be polymerized (including cross-linked), e.g., by the addition of a cross-linking catalyst and/or accelerator and/or heating and/or irradiating the shaped composition.

Referring to FIG. 2, in operation, the projectile including the aerial combustion shell 100 is placed within a launcher 200 e.g., supported on a support 208 overlying a lift charge 204 and an ignition source such as a fuse or electric match 206.

For example, the lift charge 204 may be a conventional loose, pressed, and/or contained explosive lift charge including one or more of black powder, nitrocellulose and other explosively combustible ingredients.

In operation, the ignition source 206 ignites the lift charge 204 which produces an explosive force including heated gases which propel the projectile 100 upward within the launcher 200. While still within the launcher 200, the outermost high combustion (primer) layer 104 is ignited by the hot gases and in turn acts to ignite the aerial combustion shell layer 102 within and/or outside of the launcher.

Figure 3:
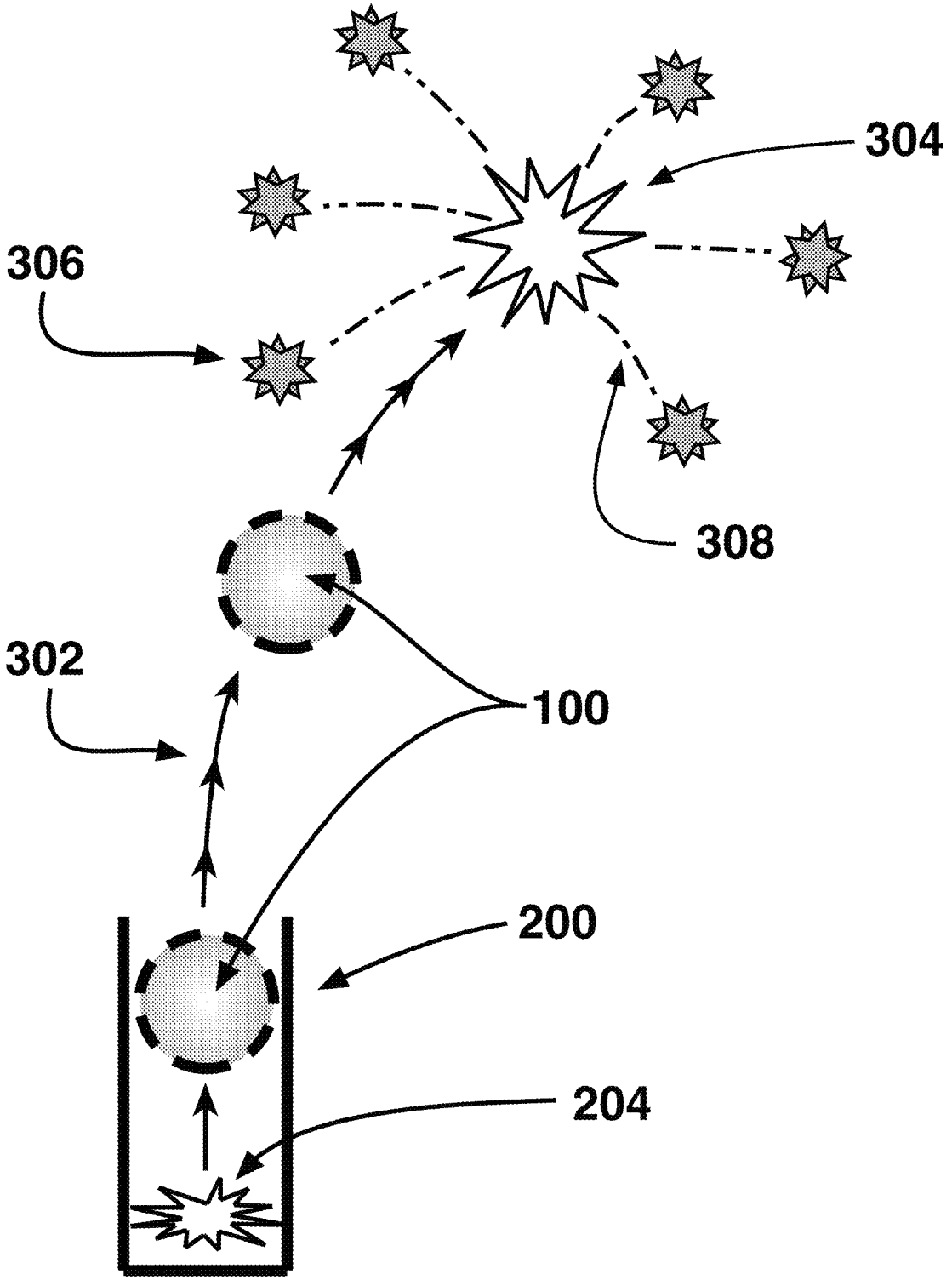
FIG. 3 is a schematic illustration of an exemplary combustible aerial shell launched from a launcher according to embodiments.

Referring to FIG. 3, in one preferred operation, the aerial combustion shell (e.g. combustible shell layer 102) burns during flight 302 as it is propelled upward to an apex. The aerial combustion shell may include a pyrotechnic effects (e.g., 110) packed in a dispersive explosive charge (e.g., 108). aerial combustion shell (e.g. combustible shell layer 102) preferably substantially uniformly burns at about substantially the same selected rate (e.g. as a result of combustible composition formulation) along substantially the entire surface and ultimately through substantially the entire thickness of the combustion shell 102, preferably completing the burn through the shell thickness at a preselected altitude, such as an apex of the launch. The main burst or dispersive explosive 108 is then exploded 304 to disperse one or more pyrotechnic effects 110, e.g., in a predetermine pattern e.g., 306, which thereby in turn ignite and/or produce pyrotechnic effects during their dispersive flight 308.

Thus, the aerial combustible shell operates as a timed fuse delay with improved aerodynamic properties, improved predictable timing, with controlled pyrotechnic effect dispersion and with little or no debris remaining following the main burst.

Figure 4:
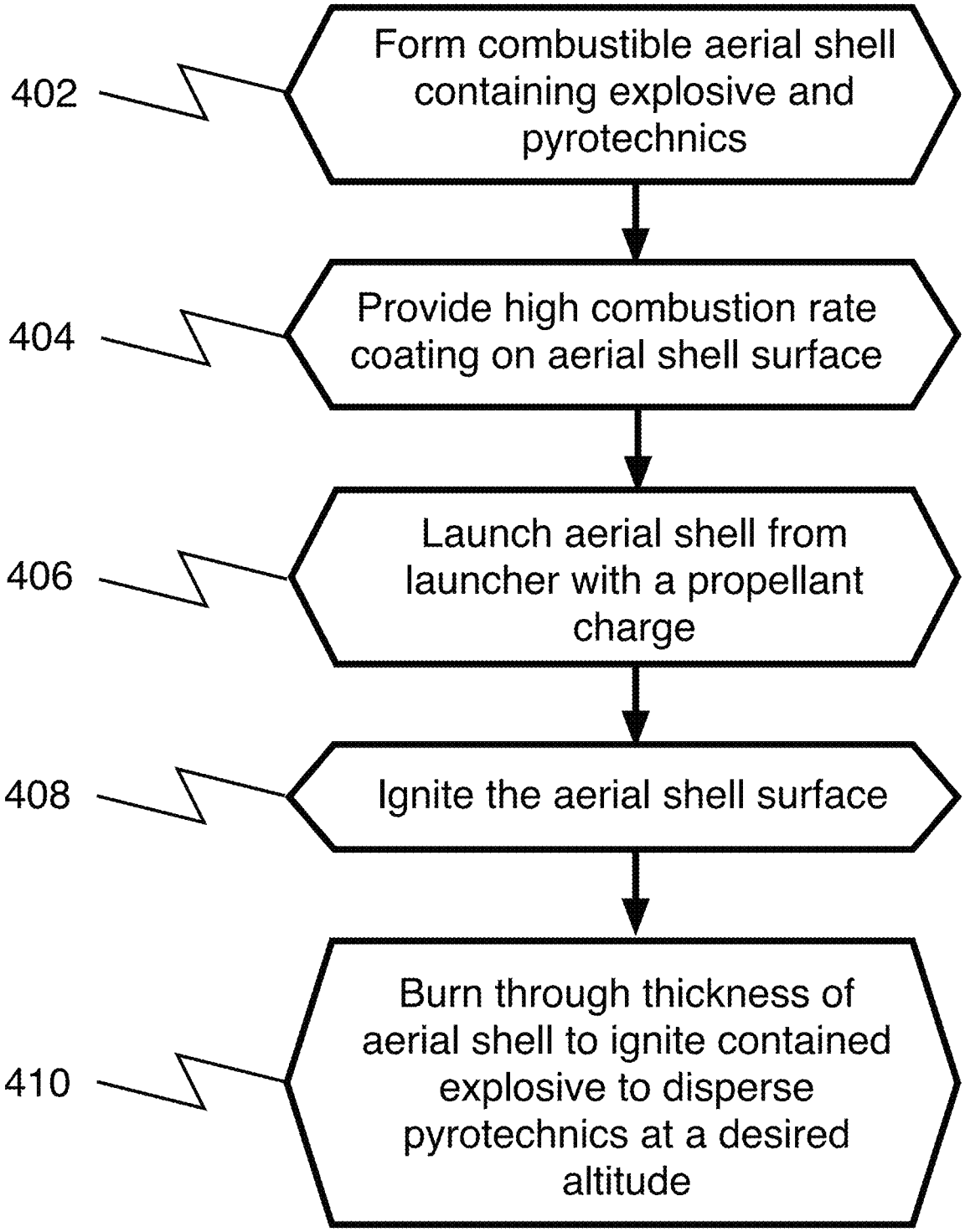
FIG. 4 is a schematic illustration of an exemplary method of forming and using a combustible aerial shell according to embodiments.

Referring to FIG. 4 is shown a method according to an embodiment.

In step 402, a combustible aerial shell is provided comprising a one or more combustible layers of material which may optionally include a pyrotechnic effect producing material and which may be formed into a shell shape with a predetermined thickness and predetermined combustion rate, the shell containing at its core an explosive dispersant and one or more pyrotechnic effects arranged in a predetermine pattern within the core to control a dispersion of the pyrotechnic effects upon ignition of the explosive dispersant.

In Step 404, the combustible aerial shell may be coated over substantially the entire outer surface with a high combustion rate material layer.

In Step 406, the combustible aerial shell may be placed in a launcher and launched into the air with a preselected force.

In Step 408, the combustible aerial shell may be ignited within and/or outside of the launcher over substantially the entire outer surface to burn through the predetermined thickness at the predetermined combustion rate.

In Step 410, the combustible aerial shell may burn through the predetermined thickness and ignite and disperse the pyrotechnic effects at a desired altitude to form a pyrotechnic display.

Although the embodiments of this disclosure have been described with respect to certain exemplary embodiments, it is to be understood that the specific embodiments are for purposes of illustration and not limitation, as other variations will occur, to those of skill in the art.

What is claimed is:

1. A pyrotechnic projectile comprising:

an aerial shell comprising at least one combustible layer of combustible material, the at least one combustible layer comprising an outermost combustible layer surrounding the at least one combustible layer, the outermost combustible layer configured to ignite on substantially an entire outer surface, the outermost combustible layer comprising a higher combustion rate than the at least one combustible layer;

the at least one combustible layer comprising an innermost combustible layer surrounding and containing at least one pyrotechnic effect and a dispersive explosive charge;

the at least one pyrotechnic effect is disposed in a predetermined pattern with respect to the innermost combustible layer, the predetermined pattern one of disposed immediately adjacent or integral with an inner surface of the innermost combustible layer and disposed spaced away from the inner surface of the innermost combustible layer;

the at least one combustible layer configured to burn substantially throughout the at least one combustible layer to thereby ignite the dispersive explosive charge to thereby disperse the at least one pyrotechnic effect.

2. The pyrotechnic projectile of claim 1, wherein the predetermined pattern is disposed spaced away from the inner surface of the innermost combustible layer.

3. The pyrotechnic projectile of claim 1, wherein the predetermined pattern is disposed immediately adjacent the inner surface of the innermost combustible layer.

4. The pyrotechnic projectile of claim 1, wherein the predetermined pattern is integral with the inner surface of the innermost combustible layer.

5. The pyrotechnic projectile of claim 1, wherein the at least one combustible layer is configured to burn through a thickness at a preselected rate to thereby ignite the dispersive explosive charge.

6. The pyrotechnic projectile of claim 1, wherein the outermost combustible layer is configured to be ignited by a primary fuse attached to a selected portion of the outermost combustible layer.

7. The pyrotechnic projectile of claim 6, wherein the primary fuse is configured as one or more of an electric match, squib, and black powder fuse device.

8. The pyrotechnic projectile of claim 1, wherein the aerial shell is configured to ignite the dispersive explosive charge at a predetermined altitude following launch from a launcher.

9. The pyrotechnic projectile of claim 8, wherein the outermost combustible layer is configured to be ignited by combustion of a lift charge within the launcher to thereby subsequently ignite the at least one combustible layer.

10. The pyrotechnic projectile of claim 1, wherein the outermost combustible layer is configured to have a combustion rate of from about 5 to about 50 times greater than the at least one combustible layer.

11. The pyrotechnic projectile of claim 1, wherein the innermost combustible layer is configured to have a combustion rate of from about 5 to about 50 times greater than the at least one combustible layer.

12. The pyrotechnic projectile of claim 1, wherein the aerial shell comprises one or more of ammonium nitrates, metal nitrates, perchlorates, phosphates, carbonates, aminotetrazoles, arsenites, oxalates, oxychlorides, peroxides, oxides, sulphates, fluorides, and metal powders.

13. The pyrotechnic projectile of claim 1, wherein the aerial shell comprises one or more of metal fuels, magnesium, aluminum, silicon, calcium, iron, titanium, zinc, and alloys thereof.

14. The pyrotechnic projectile of claim 1, wherein the aerial shell comprises one or more of non-metal fuels, charcoal, sulfur, boron, hexamine, nitroguanidine, dextrin, camphor, red gum benzoic acid, nitrocellulose, and cellulose.

15. The pyrotechnic projectile of claim 1, wherein the aerial shell comprises one or more of Mg, Sr, Ti, Cl, metal colorants, Sr(NO)3, SrCO3, PARLON™, Ammonium Perchlorate (AP), hexachloroethane, paroils (chlorinated short-chain hydrocarbons) and polyvinylchloride (PVC).

16. The pyrotechnic projectile of claim 1, wherein the aerial shell comprises one or more of polyvinyl nitrate, nitrocellulose, polyvinyl chloride, polyvinyl acetate, chlorofluoroethylene, and polymers and copolymers thereof.

17. The pyrotechnic projectile of claim 1, wherein the aerial shell comprises one or more of thermosetting polymers, rubber, polybutadiene, polyurethane, furans, organic resins, acrylic resins, polyester resins, epoxy resins, vinyl, PARLON™, and vinyl ester resins.

18. A method of igniting and dispersing a pyrotechnic effect comprising:

providing an aerial shell comprising at least one combustible layer of combustible material, the aerial shell comprising an outermost combustible layer surrounding the at least one combustible layer, the outermost combustible layer ignited to thereby subsequently ignite the at least one combustible layer on substantially an entire outer surface, the outermost combustible layer comprising a higher combustion rate than the at least one combustible layer;

the at least one combustible layer comprising an innermost combustible layer surrounding and containing at least one pyrotechnic effect and a dispersive explosive charge;

the at least one pyrotechnic effect is disposed in a predetermined pattern with respect to the innermost combustible layer, the predetermined pattern one of disposed immediately adjacent or integral with an inner surface of the innermost combustible layer and disposed spaced away from the inner surface of the innermost combustible layer;

igniting the at least one combustible layer to burn substantially throughout the at least one combustible layer to thereby ignite the dispersive explosive charge to thereby disperse the at least one pyrotechnic effect.

19. The method of claim 18, wherein the at least one combustible layer is ignited by one or more of a primary fuse attached to a selected portion of the outermost combustible layer and combustion of a lift charge within a launcher containing the aerial shell.

20. The method of claim 18, wherein the outermost combustible layer has a combustion rate of from about 5 to about 50 times greater than the at least one combustible layer.

* * * * *